United States Patent [19]

Yamazaki

[11] Patent Number: 4,705,580

[45] Date of Patent: Nov. 10, 1987

[54] CUTTING METHOD TO BE APPLIED TO PRODUCING HELICAL SPRINGS BY COLD-FORMING THICK HIGH-STRENGTH WIRE

[75] Inventor: Takao Yamazaki, Fujisawa, Japan

[73] Assignee: Neturen Co., Ltd., Tokyo, Japan

[21] Appl. No.: 863,253

[22] Filed: May 14, 1986

[30] Foreign Application Priority Data

Aug. 27, 1985 [JP] Japan ..... 60-186720

[51] Int. Cl.[4] ..... C21D 9/52

[52] U.S. Cl. ..... 148/154; 148/156

[58] Field of Search ..... 148/156, 154, 150

[56] References Cited

U.S. PATENT DOCUMENTS 4,336,081 6/1982 Hijikata et al. ..... 148/150

*Primary Examiner*—R. Dean

*Attorney, Agent, or Firm*—Wenderoth, Lind & Ponack

[57] ABSTRACT

A cutting method to be applied to producing helical springs by cold-forming a thick high-strength wire having a tensile strength in the range of 1765 to 2157 N/mm$^2$ and a diameter in the range of 8 to 16 mm on a coiling machine, and then the wire is cut at the end coil of the coiled portion to provide a helical spring. A predetermined range about a position on the wire at a distance coresponding to the length of wire in the helical spring from the free end of the wire fed to the coiling machine is heated to a temperature within a predetermined temperature range. Therefore, the end coil of the helical spring is formed by the heated portion of the wire, and hence the helical spring is cut off the wire at a position in the heated portion. Accordingly, the helical spring can be cut with the cutting mandrel and the cutting blade or the coiling machine by a small shearing force and, since the cut end is only a portion of the end coil of the helical spring, the mechanical properties of the helical spring are not affected by cutting in the least.

3 Claims, 4 Drawing Figures

CUTTING METHOD TO BE APPLIED TO PRODUCING HELICAL SPRINGS BY COLD-FORMING THICK HIGH-STRENGTH WIRE

BACKGROUND OF THE INVENTION

The present invention relates to a cutting method to be applied to producing helical springs by cold-forming a thick high-strength wire in a helical coil and cutting the wire at the end coil of the helical coil to seperate the helical coil, namely, a helical spring from the wire.

The company to which the inventor of the present invention belongs has previously developed a technique for producing highly cold-formable high-strength spring wires having a tensile strength of 1471 N/mm$^2$ or above, in which a wire is hardened by heating the wire at a high rate through induction heating or the like and quenching the heated wire, then the hardened wire is heated through induction heating or the like at a high rate for a short time of 60 sec. or less at a predetermined temperature in the range of 300° to 600° C., and then the hardened and heated wire is cooled while the wire is fed continuously to the hardening process, and a technique for producing a high-strength spring having very excellent spring properties, in which the high-strength spring wire porduced by the former technique is cold-coiled in a helical spring, and then the helical spring is held at a predetermined temperature in the range of 300° to 500° C. for a predetermined time in an electric furnace or the like. These techniques are disclosed in U.S. Pat. Nos. 4,407,683 and 4,336,081, respectively.

Thick high-strength spring wires manufactured by the technique according the invention disclosed in U.S. Pat. No. 4,407,683 are, in most cases, those having a diameter in the range of 8 to 16 mm and a tensile strength in the range of 1765 to 2157 N/mm$^2$ for the suspension springs of vehicles. In manufacturing a helical spring according to U.S. Pat. No. 4,336,081 by using the thick high-strength spring wire manufactured through processes according to U.S. Pat. No. 4,407,683, the spring wire is cold-coiled in a helical coil and the spring wire is cut at the end coil of the helical coil to provide a helical spring. These processes of the prior art for cold-coiling the spring wire and cutting the spring wire will be described briefely hereinafter with reference to FIG. 1.

In FIG. 1, there are shown an supply stand 1 and a coiling machine CM. The coiling machine CM comprises, as principal components, feed rollers 2, a wire guide 3, coiling rolls 4*a* and 4*b*, a pitch tool 5, a cutting mandrel 6 and a cutter 7. A coil of a thick high-strength wire W is supported on the supply stand 1. The thick high-strength wire W is drawn out from the unwinding stand 1 by the feed rollers 2 passes through the wire guide 3 and engages the coiling rolls 4*a* and 4*b* sequentially. The coiling rolls 4*a* and 4*b* deflect the wire W from the original course of advancement so that the wire W is wound around the cutting mandrel 6, while the pitch tool 5 regulates the pitch of coils of the wire W so that the coils are formed at a predetermined pitch. Thus, a predetermined number of coils are formed on the cutting mandrel 6. Upon the completion of forming a predetermined number of coils of the wire W, the wire feeding operation is interrupted temporarily. While the wire feeding opration is interruped, the wire W is cut at the end coil by nipping a position in the end coil between the stationary cutting mandrel 6 and the vertically movable cutter 7 to separate the coils of the wire W from the wire W. Thus a helical spring is provided.

Cutting the wire W at the end coil requires a very large shearing force when the wire W has a large diameter and a high strength. For example, the shearing force required for cutting a wire having a diameter of 14.0 mm and a tensile strength of 2,010 N/mm$^2$ is $$\frac{14 \times 14 \times 3.14}{4} \times 2010 \times \frac{2}{3} = 20{,}617\ (N) = 21 \text{ tons.}$$

Since the cutting mandrel 6 and the cutter 7 are required to apply such a large force to a 14.00 mm diameter wire, the edge of the cutter 7 is nicked or the cutting mandrel 6 and the cutter 7 are broken very often, even if the material and hardness of the cutting mandrel 6 and the cutter 7 are selected properly, and hence the service life of the cutting mandrel 6 and the cutter 7 is very short. Therefore, the ratio of the maintenance cost including the costs of those members to the helical spring forming cost is very large.

Since cold-coiling a thick wire is difficult, it is common knowledge in manufacturing helical springs to hot-coil a wire in a helical coil, to cut the helical coil from the wire and to subject the helical coil to heat treatment to produce a helical spring having desired mechanical properties. The invention disclosed in U.S. Pat. No. 4,407,683 constituted a breakthrough and overcame the difficulty in cold-forming helical springs. However, the invention brought about the above-mentioned new difficulty in cutting the end coil of the helical coil.

Cutting a thick high-strength wire at the end coil in manufacturing helical springs according to the above-mentioned prior invention has never been dreamt of. Accordingly, there is no prior art which is analogous to the present invention within the knowledge of the inventor of the present invention.

OBJECTS OF THE INVENTION

It is a primary object of the present invention to provide a cutting method to be applied to producing helical springs by cold-forming a thick high-strength wire in a helical coil, cutting the wire at the end coil of the helical coil to separate the helical coil, namely, a helical spring, from the wire, for very easily cutting the wire without requiring the cutting mandrel and the cutter of a coiling machine to a high shearing force to the wire and for remarkably extending the service life of those cutting components. It is another object of the present invention to provide a cutting method capable of not deteriorating the mechanical properties of the helical springs in the least.

The above and other objects, features and advantages of the present invention will become more apparent from the following description taken in conjunction with the accompanying drawings.

DETAILED DESCRIPTION

A cutting method according to the present invention will be described with reference to a helical spring forming line shown in FIG. 2.

Figure 1:
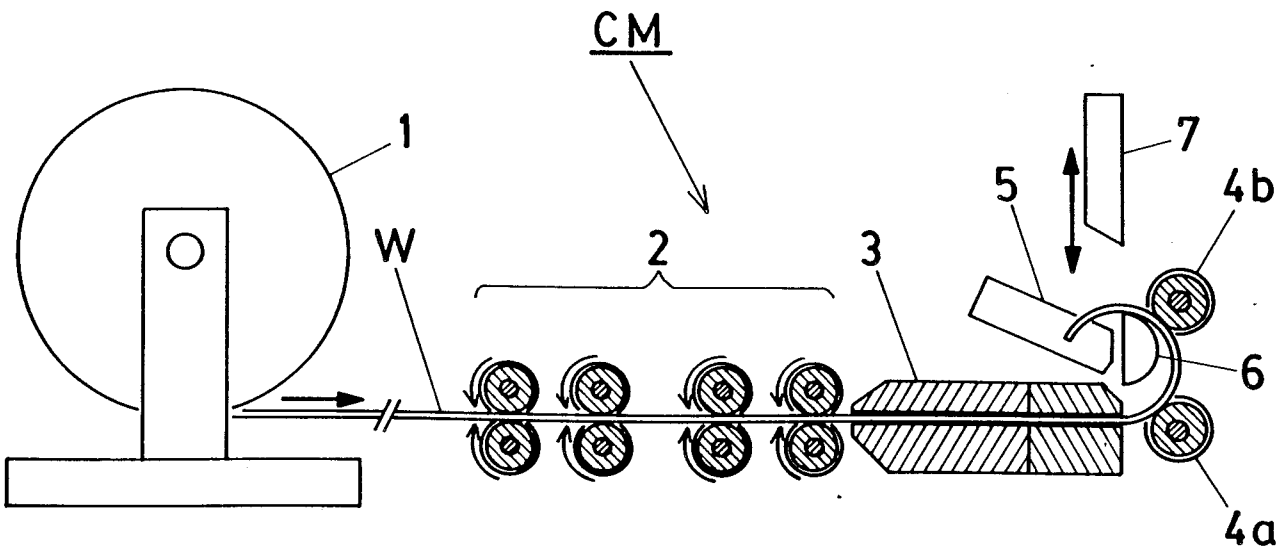
FIG. 1 is a front elevation of a helical spring forming line for carrying out the conventional cutting method.
Figure 2:
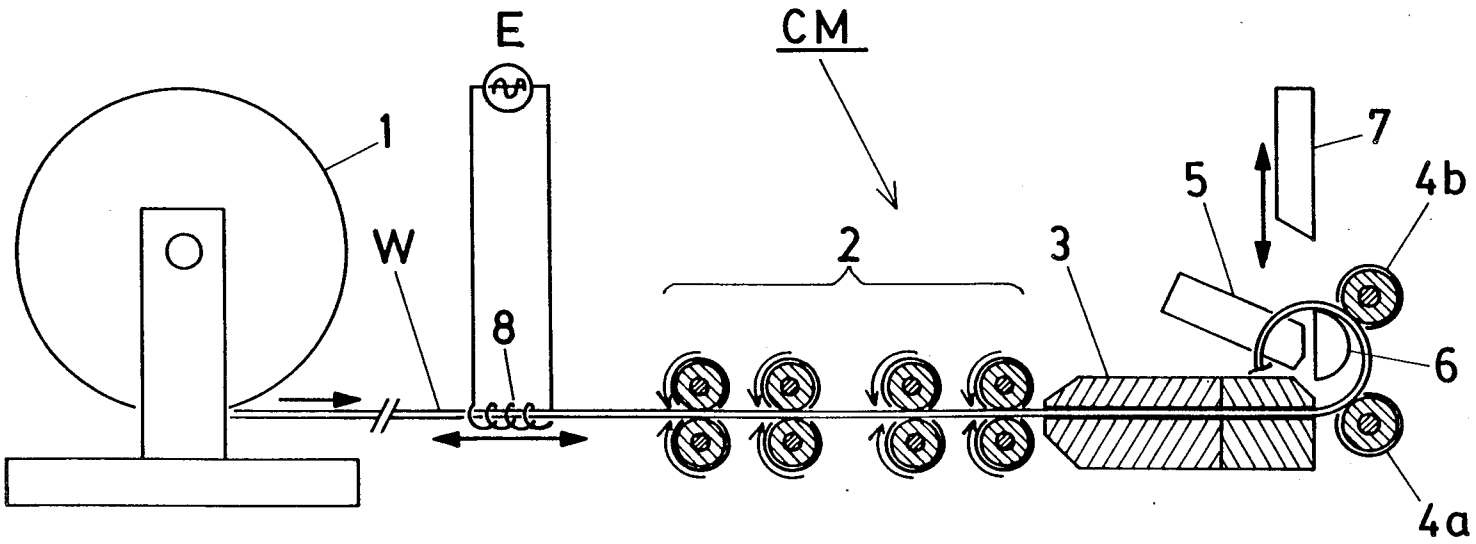
FIG. 2 is a front elevation of a helical coil forming line for carrying out a cutting method according to the present invention.

Referring to FIG. 2, there are shown a supply stand 1 and a coiling machine CM. The coiling machine CM comprises, similarly to the coiling machine employed in the conventional helical spring forming line, a series of feed rollers 2, a wrie guide 3, coiling rolls 4*a* and 4*b*, a pitch tool 5, a cutting mandrel 6 and a cutter 7. According to the present invention, an induction heating coil 8 is disposed in the wire path on the coiling machine CM, as means for heating the wire at a high heating rate. The induction heating coil 8 is connected to a high frequency power unit E capable of supplying power of fixed level and a fixed frequency. The induction heating coil 8 is movable in opposite directions along the wire path, because the position of the induction heating coil 8 needs to be adjusted according to length of the wire in a helical spring to be formed. The position of the induction heating coil 8 is adjusted before starting the helical spring forming operation so that the middle of the induction heating coil 8 is located at a position on the wire path remoted from a position of the cutter 7 by a distance corresponding to the length of the wire W in a helical spring to be formed. Preferably, the coil length of the induction heating coil 8 is in the range of 50 to 60 mm. The significance of such a limitation to the coil length will become apparent from the description of the function of the induction heating coil 8 in relation to the functions of the rest of the components.

Upon the completion of coiling the wire W in a predetermined helical coil, the wire feeding operation of the coiling machine CM is interrupted temporarily to cut the wire W at the end coil of the helical coil through the cooperative shearing action of the cutting mandrel 6 and the cutter 7. In view of productivity considerations, the preferable duration of the interruption of the wire feeding operation, namely, the duration of power supply to the induction heating coil 8, is in the range of 1 to 2 sec.

The power supply capacity of the high frequency power unit E is selected so as to enable the induction heating coil 8 to heat the standstill wire W during the duration of power supply so that the surface temperature of a portion of the wire W of a length corresponding to the coil length is raised to a temperature in the range of 450° to 750° C. and also to heat the wire W so that the average temperature in a section in the heated portion of the wire W is in the range of 400° to 700° C. when the heated portion of the wire W is moved to the cutting position after heating. That is, a portion of the wire W is heated so that the heat given to the heated portion of the wire W is transferred by conduction from the surface to the central portion of the wire W so that the temperature of a section in the heated portion of the wire W is in the range of 400° to 700° C. while the heated portion is advanced and coiled to form the end coil of a helical spring.

The lower limit of the surface temperature and the lower limit of the average temperature of a section of the heated portion of the wire W heated by the induction heating coil 8 are decided selectively at 450° C. and 400° C., respectively, because the tensile strength of the heated portion of the wire W at the moment of cutting is not reduced effectively and hence a large shearing force is required for shearing the wire W, if the surface temperature and the average temperature are below the respective lower limits. The wire can be sheared easily if the wire W is heated to a surface temperature above 750° C. in the predetermined duration of heating (1 to 2 sec) by supplying a large amount of power to the induction heating coil 8 and the average temperature of a section of the heated portion of the wire at the moment of cutting is maintained at a temperature above 700° C. However, it is possible that a portion of the wire W for forming the effective coils of a helical spring is heated adversely by conduction when the wire W is heated to an excessively high temperature. Therefore, the upper limit of the surface temperature and the upper limit of the average temperature are decided selectively at 750° C. and 700° C., respectively. Heating the wire W at an excessively high temperature deteriorates the mechanical properties of the helical spring formed by the excessively heated wire. When a small power of comparatively high frequency is supplied to the induction heating coil 8 to heat the wire W to a surface temperature above 750° C., such a low power is unable to give sufficient heat to reduce the tensile strength of the heated portion of the wire at the moment of cutting to desirable extent, and hence a large shearing force is necessary for shearing the heating portion of the wire.

When a thick high-strength wire manufactured through a process according to the invention disclosed in U.S. Pat. No. 4,336,081 is heated so that the average temperature of a section in the heated portion is in the range of 400° to 700° C. at the moment of cutting, the tensile strength of the heated portion is reduced approximately to half the original tensile strength of the wire.

The power capacity of the high frequency power unit E is selected taking into consideration the range of diameter of wires to be coiled on the coiling machine, time interval between the completion of heating and cutting, and the rate of heat conduction in the wires so as, to deliver appropriate power to the induction heating coil so that the entire area of a section in the heated portion of the wire is heated to a temperature capable of reducing the tensile strength of the heated portion to an extent to facilitate the shearing of the heated portion. Heating will not adversely affect the mechanical properties of the helical spring formed by the wire and the induction heating coil is able to heat the wire to a predetermined temperature in a short heating time such as a time in the range of 1 to 2 sec. Ordinarily, the output frequency of the high frequency powser unit E is in the range of 3 to 20 KHz, and the output of the high frequency power unit E is regulated according to the relevant conditions.

To be concrete, in forming a helical spring having a wire length of 2,500 mm by a 15.1 $\phi$ diameter wire W by heating a portion of the wire W having a length of 60 mm (coil length of the induction heating coil 8) at a surface temperature of 750° C. in 2 sec and by cutting the wire W at the heated portion 6 sec after the completion of heating when the temperature of the entire area of a section in the heated portion is 600° C., power to be delivered to the induction heating coil 8 is 16 Kw, the power flux density is 0.5 Kw/cm$^2$ and the operating frequency is 17 KHz. Therefore, in frequency and 20 Kw in output capacity is suitable for such a mode of coiling operation.

The present invention has a further feature to obviate the deterioration of the mechanical properties of helical springs formed through a process according to the present invention; the length of the heated portion, namely, the coil length of the induction heating coil 8, is decided selectively to meet such a purpose. Since the mean spring diameter D of helical springs formed by coiling wires having wire diameter in the range of 8 to 16 mm is at least 50 mm, when the length of wire in the end coil is two-thirds of the mean spring diameter D, $l=\pi D\times\frac{2}{3}=104.7$ mm$\approx$105 mm. Thus, the length of wire in the end coil of such helical springs is 150 mm or above. Since the induction heating coil 8 is located so that the middle of the induction heating coil 8 is located at a position on the wire path before the cutter 7 practically by a distance corresponding to the length of the wire in a helical spring to be formed, the wire is cut practically at the middle of the portion heated by the induction heating coil 8 and, when the coil length of the induction heating coil 8 is in the range of 50 to 60 mm, the length of heated portion in a helical spring after separated from the wire is in the range of 25 to 30 mm. Accordingly, the length of the heated portion in the helical spring is only one-third to one-fourth of the length of wire in the end coil. Naturally, the effect of heat conduction in the wire in the longitudinal direction is taken into consideration.

Figure 3A:
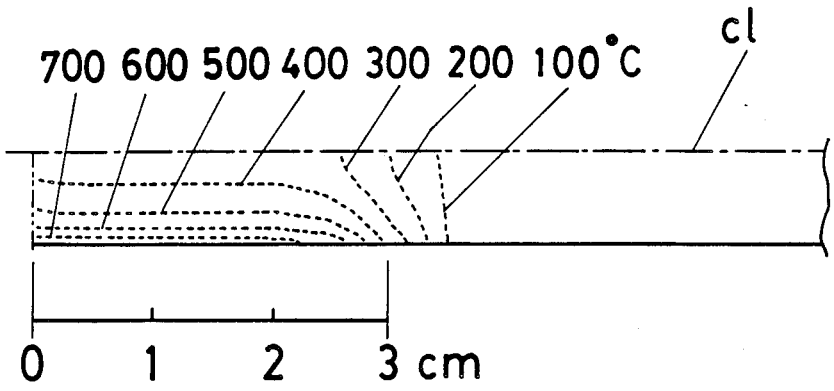
FIGS. 3*a* and 3*b* are views showing temperature distribution in the heated portion of a wire at the completion of heating, and the effect of conduction of heat in the heated portion, respectively.
Figure 3B:
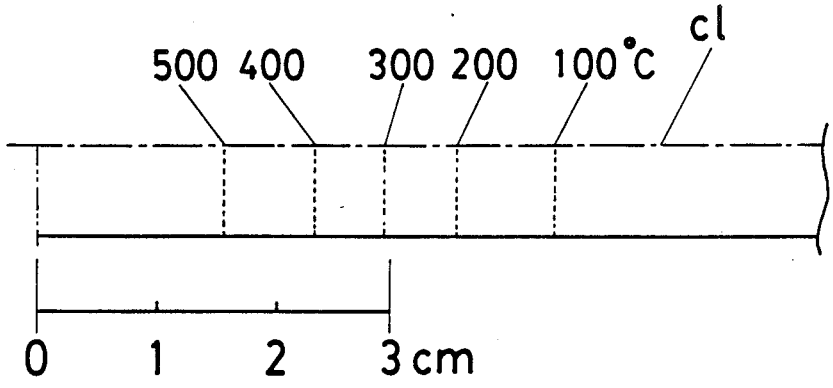

The mode of longitudinal heat conduction in the wire was analyzed theoretically by the finite element method using a computer. The results of the analysis are shown in FIGS. 3*a* and 3*b*. It was supposed that a 15 mm diameter wire was heated by an induction heating coil 8 having a coil length of 60 mm to a surface temperature of 750° C. FIG. 3*a* shows temperature distribution in the half of the heated portion at a moment six seconds after the end of heating. In the analysis, the effect of radiation loss was not taken into consideration. As apparent from the results of the analysis, the temperature of the entire area of sections in the vicinity of cutting position is maintained at 500° C. at the moment of cutting and the temperature of portions apart from the middle of the heated portion by 35 mm and above is 100° C. or below. Accordingly, it is apparent that the half of the length of wire in the end coil is not affected by heating. Thus, the analysis proved that the present process never deteriorates the mechanical properties of helical springs manufactured by a method according to the present invention.

In manufacturing helical springs on the helical spring forming line for carrying out the method according to the present invention, the length of wire in the helical spring is obtained through calculation, and then the induction heating coil 8 is located so that the middle of the induction heating coil 8 is located at a position on the wire path before the cutter 7 of the coiling machine CM by a distance corresponding to the calculated length of wire in the helical spring and the wire W drawn out from the coil of wire supported on the supply stand 1 by the feed rollers 2 is passed through the induction heating coil 8. Then, the coiling machine CM is started. The wire W is fed by the feed rollers 2 via the wire guide 3 and is coiled by means of the coiling rolls 4*a* and 4*b* and the pitch tool 5 in a predetermined helical coil. Upon the completion of the coiling process, the wire feeding operation is interrupted for a predetermined period of time. During the interruption of the feeding operation, the cutter 7 is lowered to cut the wire W at the end coil of the helical coil in cooperation with the cutting mandrel 6, while the induction heating coil 8 heats the portion of the wire staying therein to a predetermined temperature. After the predetermined period of time has passed, the feed rollers 2 are restarted to feed the wire W, and then the same coiling, cutting and heating cycles are repeated. The wire W is always cut at a position practically corresponding to the middle of the heated portion thereof. Since the hardness of the heated portion of the wire W is reduced, the wire W can be cut very easily.

The requisite shearing force for cutting a thick high-strength wire having a tensile strength of 2010 N/mm$^2$ and a diameter of 14.0 mm by the conventional method is approximately 21 tons, where as the requisite shearing force for cutting the same wire by the method according to the present invention is in the range of 10.3 to 12.3 tons, which is nearly half as large as the requisite shearing force for cutting the wire by the conventional method, provided that the tensile strength of the heated portion of the wire is reduced to a value in the range of 981 to 1171 N/mm$^2$ (100 to 120 kgf/mm$^2$).

The embodiment has been described hereinbefore as employing the induction heating coil 8 as means for heating the wire at a high heating rate, however, it is also to heat a portion of the wire at a high heating rate by clamping the wire at two separate positions spaced apart by a predtemined distance, for example, a distance in the range of 50 to 60 mm, with a pair of electrodes capable of clamping the wire W and supplying a current through the electrodes to heat heating the portion extending between the electrodes at a high rate to a predetermined temperature.

Furthermore, in the embodiment described hereinbefore, the heating means for heating the wire at a high rate, namely, the induction heating coil 8, is disposed before the feed rollers 2, however, the heating means may be adapted to be located, if necessary, at a position in the arrangement of the feed rollers 2 according to the length of wire in the helical spring, that is, the heating means may be incorporated into the coiling machine CM.

As apparent from the foregoing description, in manufacturing helical springs by cold-coiling thick high-strength wires, the cutting method according to the present invention is capable of reducing the strength of a portion of the wire where the wire is to be cut without deteriorating the requisite mechanical properties of the helical spring in the least so that the requisite shearing force for cutting the wire at the portion is reduced practically to the half of the requisite shearing force for cutting the same wire by the conventional cutting method.

Accordingly, the cutting method according to the present invention reduces the accidental chipping and breakage of the cutting mandrel and the cutter remarkably, and hence the service life of the cutting mandrel and the cutter is extended greately. Consequently, the cost of manufacturing helical springs by cold-coiling thick high-strength wires is reduced substantially and the cutting method according to the present invention never affects adversely the mechanical properties of the helical coil springs.

What is claimed is:

1. A cutting method for producing helical springs by cold-forming a thick high-strength wire being fed continuously to a coiling machine having a wire path and cutter in proximity to the end of said path, in a helical coil and cutting the thick high-strength wire at the end coil of the helical coil, which comprises:

(a) interrupting wire feeding operation for a predetermined period of time immediately after the helical coil has been formed on the coiling machine;

(b) heating a portion of a predetermined length of the wire on the wire path of the coiling machine before the cutter of the coiling machine, at a distance corresponding to the length of wire in the helical coil from the position of the cutter, by heating means for heating the wire at high rate to a predetermined temperature in the range of 400° to 750° C. within the predetermined period of time in which the wire feeding operation is interrupted; and (c) cutting the wire substantially in the middle of the heated portion.

2. The cutting method according to claim 1, wherein said heating means for heating the wire at high rate is high frequency induction heating or direct electric resistance heating.

3. The cutting method according to claim 1, wherein the half of the predetermined length of the wire heated by the heating means is equal to or less than the half of the length of wire in the end coil of the helical coil cold-formed on the coiling machine.

* * * * *